US011092165B2

(12) United States Patent
Hayashi

(10) Patent No.: US 11,092,165 B2
(45) Date of Patent: Aug. 17, 2021

(54) CENTRIFUGAL COMPRESSOR AND TURBOCHARGER INCLUDING THE SAME

(71) Applicant: MITSUBISHI HEAVY INDUSTRIES ENGINE & TURBOCHARGER, LTD., Sagamihara (JP)

(72) Inventor: Yoshihiro Hayashi, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 63 days.

(21) Appl. No.: 16/619,415

(22) PCT Filed: Nov. 16, 2017

(86) PCT No.: PCT/JP2017/041335
§ 371 (c)(1),
(2) Date: Dec. 4, 2019

(87) PCT Pub. No.: WO2019/097640
PCT Pub. Date: May 23, 2019

(65) Prior Publication Data

US 2020/0173461 A1 Jun. 4, 2020

(51) Int. Cl.
*F04D 29/44* (2006.01)
*F04D 17/10* (2006.01)
(Continued)

(52) U.S. Cl.
CPC ..... *F04D 29/441* (2013.01); *F04D 17/10* (2013.01); *F04D 29/284* (2013.01);
(Continued)

(58) Field of Classification Search
CPC .... F04D 17/10; F04D 29/441; F04D 29/4206; F05D 2250/52; F05D 2250/90
See application file for complete search history.

(56) References Cited

U.S. PATENT DOCUMENTS 2,836,347 A * 5/1958 Barr ..... F04D 29/441 415/228
4,900,225 A * 2/1990 Wulf ..... F04D 29/441 415/224.5
(Continued)

FOREIGN PATENT DOCUMENTS

CN 104819166 A 8/2015
DE 13 2013 317 694 A1 7/2014
(Continued)

OTHER PUBLICATIONS

Office Action dated Jul. 3, 2020 issued in counterpart Chinese Application No. 201780089987.0 with machine Translation.
(Continued)

*Primary Examiner* — Ninh H. Nguyen
(74) *Attorney, Agent, or Firm* — Birch, Stewart, Kolasch & Birch LLP

(57) ABSTRACT

A centrifugal compressor includes a housing which includes a scroll portion with a spiral scroll flow passage being formed on an outer peripheral side of an impeller, and a diffuser portion with a diffuser flow passage being formed, the diffuser flow passage extending along the scroll flow passage on a radially inner side of the scroll flow passage and communicating with the scroll flow passage. The diffuser flow passage includes an inner flow passage portion extending from an inlet portion of the diffuser flow passage to a throat portion with a flow passage height thereof decreasing, and an outer flow passage portion extending from the throat portion to an outlet portion of the diffuser flow passage. An average distance from the rotational axis to the throat portion within a range where an angular range in a circumferential direction with reference to a tongue section of the scroll portion is between 240° and 300° is greater than an average distance from the rotational axis to the throat
(Continued)

portion outside the range where the angular range is between 240° and 300°.

8 Claims, 5 Drawing Sheets

(51) Int. Cl.
*F04D 29/28* (2006.01)
*F04D 29/42* (2006.01)

(52) U.S. Cl.
CPC ..... *F04D 29/4206* (2013.01); *F05D 2220/40* (2013.01); *F05D 2250/52* (2013.01); *F05D 2250/90* (2013.01)

(56) References Cited

U.S. PATENT DOCUMENTS 8,157,516 B2 * 4/2012 Chen ..... F04D 29/441 415/206
2006/0275113 A1 * 12/2006 Chen ..... F04D 29/162 415/206
2014/0255175 A1 9/2014 Zheng et al.
2016/0108921 A1 4/2016 Ishikawa

FOREIGN PATENT DOCUMENTS

JP 10-176699 A 6/1998
JP 2014-202102 A 10/2014
WO WO 2012/128277 A1 9/2012
WO WO 2015/064272 A1 5/2015

OTHER PUBLICATIONS

International Preliminaly Report on Patentability and English translation of the Written Opinion of the International Searching Authority for International Application No. PCT/JP2017/041335, dated May 28, 2020.
International Search Report for International Application No. PCT/JP2017/041335, dated Feb. 20, 2018.
Extended European Search Report for corresponding European Application No. 17931835.7, dated May 21, 2021.

* cited by examiner

CENTRIFUGAL COMPRESSOR AND TURBOCHARGER INCLUDING THE SAME

TECHNICAL FIELD

The present disclosure relates to a centrifugal compressor and a turbocharger including the same.

BACKGROUND

Recently, an expansion in operational area of a centrifugal compressor is required. Patent Document 1 discloses a centrifugal compressor in which a radial position of a throat portion of a diffuser flow passage in a region in the vicinity of a scroll-start part of a scroll flow passage is disposed on the radially outer side of a radial position of the throat portion of the diffuser flow passage in a region in the vicinity of a scroll-end part of the scroll flow passage. With such a configuration, it is possible to reduce a circumferential fluctuation of a static pressure at the outlet of the diffuser flow passage on a low flow rate side, and thus to expand the operational area to the low flow rate side.

CITATION LIST

Patent Literature

Patent Document 1: WO2015/064272A

SUMMARY

Technical Problem

However, Patent Document 1 does not disclose the expansion of the operational area to a high flow rate side. It is generally known that an enhanced flow is formed due to an excessive volume flow rate flowing into the scroll flow passage at a high-flow operation point of the centrifugal compressor, and the static pressure on the outlet side of the scroll flow passage tends to decrease. As a result of researches by the present inventors, it became clear that due to the influence of the static pressure field, a dynamic pressure locally becomes excessive in the vicinity of the outlet of the scroll flow passage inside the adjacent diffuser flow passage, and an efficiency degradation amount associated with a pressure loss in the part increases.

In view of the above, an object of at least one embodiment of the present disclosure is to provide a centrifugal compressor whose efficiency degradation on the high flow rate side is suppressed and a turbocharger including the same.

Solution to Problem (1) A centrifugal compressor according to at least one embodiment of the present disclosure includes an impeller and a housing. The housing includes a scroll portion with a spiral scroll flow passage being formed on an outer peripheral side of the impeller, and a diffuser portion with a diffuser flow passage being formed, the diffuser flow passage extending along the scroll flow passage on a radially inner side of the scroll flow passage and communicating with the scroll flow passage. The diffuser flow passage includes an inner flow passage portion extending from an inlet portion of the diffuser flow passage to a throat portion with a flow passage height thereof decreasing, the throat portion being positioned on a radially outer side of the inlet portion, and an outer flow passage portion extending from the throat portion to an outlet portion of the diffuser flow passage. An average distance from the rotational axis to the throat portion within a range where an angular range in a circumferential direction with reference to a tongue section of the scroll portion is between 240° and 300° is greater than an average distance from the rotational axis to the throat portion outside the range where the angular range is between 240° and 300°.

With the above configuration (1), since the average distance from the rotational axis of the impeller to the throat portion in a region in the vicinity of a scroll-end part of the scroll flow passage is greater than the average distance from the rotational axis to the throat portion in a region other than the region in the vicinity of the scroll-end part of the scroll flow passage, a flow passage area of the diffuser flow passage in the region in the vicinity of the scroll-end part expands, reducing a pressure loss. Thus, it is possible to suppress efficiency degradation of the centrifugal compressor on a high flow rate side.

(2) In some embodiments, in the above configuration (1), a distance from the rotational axis to the throat portion changes at least partially in the circumferential direction, and becomes maximum within the range where the angular range is between 240° and 300°.

With the above configuration (2), since the distance from the rotational axis to the throat portion in the region in the vicinity of the scroll-end part of the scroll flow passage becomes maximum, the flow passage area of the diffuser flow passage in the region in the vicinity of the scroll-end part expands, reducing the pressure loss. Thus, it is possible to suppress efficiency degradation of the centrifugal compressor on the high flow rate side.

(3) In some embodiments, in the above configuration (1) or (2), an average flow passage height in the throat portion within the range where the angular range is between 240° and 300° is not less than an average flow passage height in the throat portion outside the range where the angular range is between 240° and 300°.

If the throat portion in the region in the vicinity of the scroll-end part of the scroll flow passage is merely positioned radially outer side of another region, the flow passage height in the throat portion becomes lower than in the other region, decreasing the flow passage area. With the above configuration (3), however, the average flow passage height in the throat portion is not less than the average flow passage height in the throat portion in the other region even if the throat portion in the region in the vicinity of the scroll-end part of the scroll flow passage is positioned radially outer side of the other region. Thus, it is possible to avoid the decrease in the flow passage area.

(4) In some embodiments, in the above configuration (3), the diffuser portion has a first inner wall surface and a second inner wall surface defining the inner flow passage portion therebetween, the first inner wall surface being perpendicular to the rotational axis, the second inner wall surface being inclined to form an acute inclination angle with respect to a plane perpendicular to the rotational axis so as to approach the first inner wall surface from the inlet portion to the throat portion, and an average of the inclination angle within the range where the angular range is between 240° and 300° is less than an average of the inclination angle outside the range where the angular range is between 240° and 300°.

With the above configuration (4), it is possible to achieve the above configuration (3) capable of avoiding the decrease in the flow passage area caused by positioning the throat portion in the region in the vicinity of the scroll-end part of the scroll flow passage radially outer side of the other region.

(5) In some embodiments, in any one of the above configurations (1) to (4), the outer flow passage portion has a circumferential range where a flow passage height thereof in at least a partial region from the throat portion to the outlet portion in a radial direction decreases circumferentially downward within a range where the angular range is between 270° and 360°.

On the low flow rate side, since the flow velocity of a compressed fluid downwardly decreases inside the scroll flow passage, the compressed fluid may flow back into the diffuser flow passage from the vicinity of the scroll-end part of the scroll flow passage, and a stall region may expand in a direction from the vicinity of the scroll-end part toward the vicinity of a scroll-start part. With the above configuration (5), the expansion of the stall region in the direction from the vicinity of the scroll-end part toward the vicinity of the scroll-start part is reduced by the circumferential range existing in the diffuser flow passage. In the circumferential range, the flow passage height in at least the partial region from the throat portion to the outlet portion in the radial direction decreases circumferentially downward in the region from the vicinity of the scroll-end part to the vicinity of the scroll-start part of the scroll flow passage. Thus, it is possible to suppress efficiency degradation of the centrifugal compressor on the low flow rate side.

(6) In some embodiments, in the above configuration (5), the diffuser portion has a third inner wall surface and a fourth inner wall surface defining the outer flow passage portion therebetween, the third inner wall surface being, perpendicular to the rotational axis, and the fourth inner wall surface has the circumferential range where the fourth inner wall surface is inclined with respect to a plane perpendicular to the rotational axis so as to approach the third inner wall surface circumferentially downward within the range where the angular range is between 270° and 360°.

With the above configuration (6), it is possible to achieve the above configuration (5) capable of reducing the expansion of the stall region in the direction from the vicinity of the scroll-end part toward the vicinity of the scroll-start part.

(7) In some embodiments, in the above configuration (5) or (6), $0.6 \leq h_D/h_C \leq 0.9$ holds, where, in the circumferential range, $h_C$ is a flow passage height in at least the partial region on a most upstream side in the circumferential direction, and $h_D$ is a flow passage height in at least the partial region on a most downstream side in the circumferential direction.

With the above configuration (7), it is possible to reduce the expansion of the stall region and to suppress efficiency degradation of the centrifugal compressor on the low flow rate side while minimizing the decrease in the flow passage area of the outer flow passage portion.

(8) A turbocharger according to at least one embodiment of the present disclosure includes the centrifugal compressor according to any one of the above configurations (1) to (7).

With the above configuration (8), it is possible to suppress efficiency degradation of the centrifugal compressor on the high flow rate side.

Advantageous Effects

According to at least one embodiment of the present disclosure, since the average distance from the rotational axis of the impeller to the throat portion in the region in the vicinity of the scroll-end part of the scroll flow passage is greater than the average distance from the rotational axis to the throat portion in the region other than the region in the vicinity of the scroll-end part of the scroll flow passage, the flow passage area of the diffuser flow passage in the region in the vicinity of the scroll-end part expands, reducing the pressure loss. Thus, it is possible to suppress efficiency degradation of the centrifugal compressor on the high flow rate side.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A centrifugal compressor according to some embodiments of the present disclosure to be shown below will be described by taking a centrifugal compressor of a turbocharger as an example. However, the centrifugal compressor in the present disclosure is not limited to the centrifugal compressor of the turbocharger, and may be any centrifugal compressor operating independently. In the following description, a fluid compressed by the compressor is air. However, the fluid can be replaced with any fluid.

Embodiment 1

Figure 1:
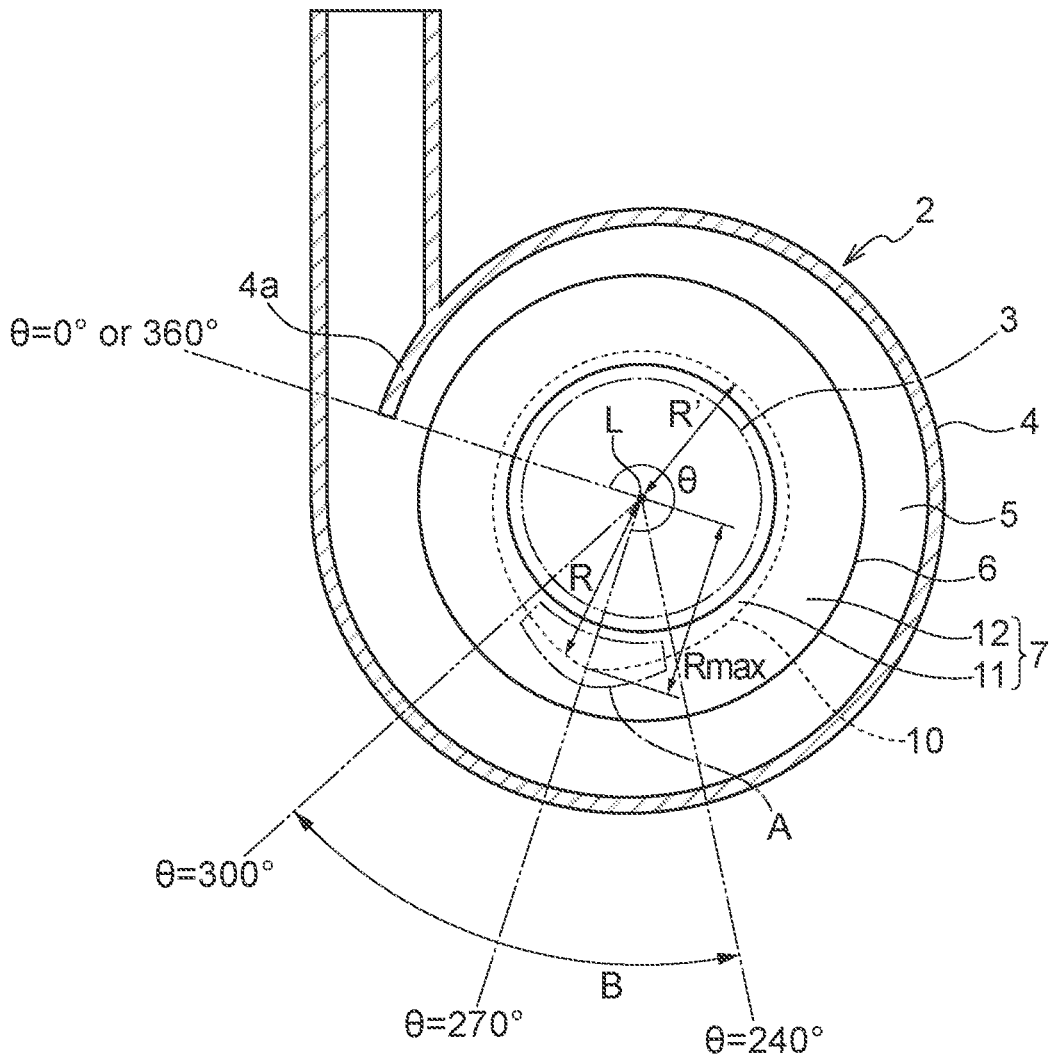
FIG. 1 is a cross-sectional view of a centrifugal compressor according to embodiment 1 of the present disclosure.

As shown in FIG. 1, a centrifugal compressor 1 according to embodiment 1 of the present disclosure includes a housing 2 and an impeller 3 disposed so as to be rotatable about a rotational axis L in the housing 2. The housing 2 includes a scroll portion 4 with a spiral scroll flow passage 5 being formed on an outer peripheral side of the impeller 3 and a diffuser portion 6 with a diffuser flow passage 7 being formed.

In the present disclosure, a circumferential position with reference to a tongue section 4*a* of the scroll portion 4 is represented by a center angle θ centered on the rotational axis L Therefore, the center angle θ representing the circumferential position of the tongue section 4*a* is 0°. However, a position of the tongue section 4*a* to mean going around from the tongue section 4*a* along the scroll flow passage 5 and returning to the tongue section 4*a* is represented as center angle θ=360°. In addition, an arbitrary range in the circumferential direction can be represented by the range of the center angle θ, and the range represented by the range of the center angle θ is defined as an angular range.

As a result of obtaining, by a CFD analysis, a dynamic pressure distribution in the diffuser flow passage 7 when the centrifugal compressor 1 operates on the high flow rate side, the present inventors find that a dynamic pressure increases in the vicinity of a scroll-end part of the scroll portion 4, that is, in the vicinity of a circumferential position where the center angle θ is 270° (a region A in FIG. 1), and efficiency degradation owing to a pressure loss increases. Thus, if the pressure loss in the region A is reduced, it is possible to improve efficiency of the centrifugal compressor 1 on the high flow rate side.

Figure 2:
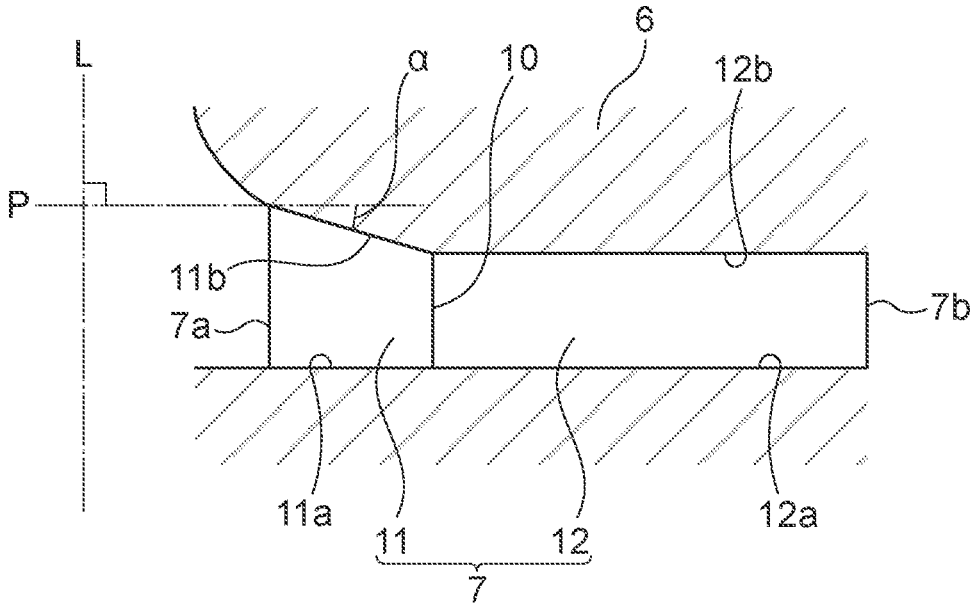
FIG. 2 is a cross-sectional view of the centrifugal compressor according to embodiment 1 of the present disclosure.

As shown in FIG. 2, the diffuser flow passage 7 includes an inner flow passage portion 11 and an outer flow passage portion 12. The inner flow passage portion 11 extends from an inlet portion 7*a* of the diffuser flow passage 7 to a throat portion 10 positioned on a radially outer side of the inlet portion 7*a* with a flow passage height thereof decreasing. The outer flow passage portion 12 extends from the throat portion 10 to an outlet portion 7*b* of the diffuser flow passage 7. The flow passage height means the width of the diffuser flow passage 7 in a direction where the rotational axis L extends.

The inner flow passage portion 11 is defined between a first inner wall surface 11*a* and a second inner wall surface 11*b* of the diffuser portion 6 facing each other in the direction where the rotational axis L extends. The outer flow passage portion 12 is defined between a third inner wall surface 12*a* and a fourth inner wall surface 12*b* of the diffuser portion 6 facing each other in the direction where the rotational axis L extends. While the first inner wall surface 11*a* is perpendicular to a plane P perpendicular to the rotational axis L, the second inner wall surface 11*b* is inclined to form an acute inclination angle α with respect to the plane P so as to approach the first inner wall surface 11*a* from the inlet portion 7*a* to the throat portion 10. Thus, the inner flow passage portion 11 is configured to extend from the inlet portion 7*a* to the throat portion 10 with a flow passage height thereof decreasing.

As shown in FIG. 1, the centrifugal compressor 1 is configured such that a distance R from the rotational axis L to the throat portion 10 in an angular range B where the center angle θ is between 240° and 300° is greater than a distance R' from the rotational axis L to the throat portion 10 in a part other than the angular range B. In other words, a radial position of the throat portion 10 in the angular range B is positioned on more radially outer side than the radial position of the throat portion 10 in the part other than the angular range B. In particular, a maximum value $R_{max}$ of the distance R is configured to be arranged at a circumferential position where the center angle θ=270°. With such a configuration, a flow passage area of the diffuser flow passage 7 in the region in the vicinity of the scroll-end part of the scroll portion 4 expands, reducing the pressure loss. Thus, it is possible to suppress efficiency degradation of the centrifugal compressor 1 on the high flow rate side.

Figure 3:
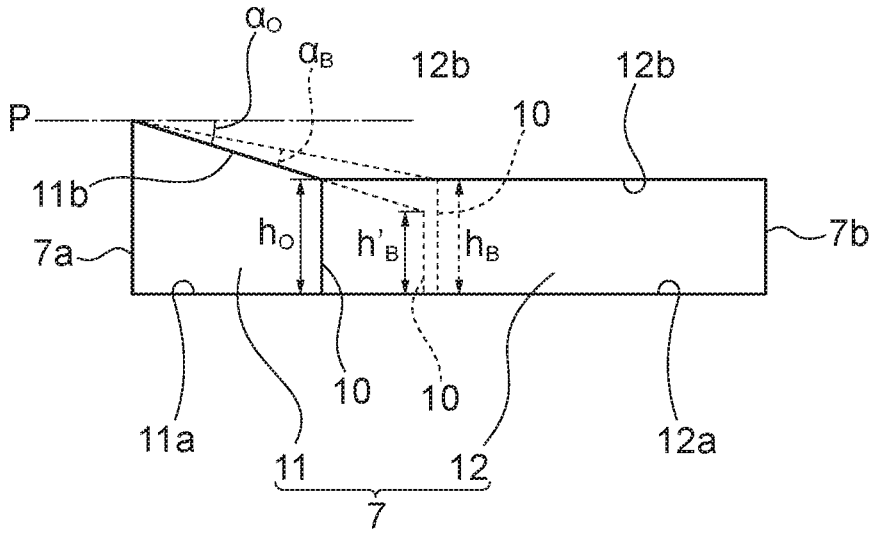
FIG. 3 is a schematic cross-sectional view of a diffuser portion of the centrifugal compressor according to embodiment 1 of the present disclosure.

However, as shown in FIG. 3, if the throat portion 10 is moved radially outward with an inclination angle $\alpha_B$ in the angular range B remaining the same as an inclination angle $\alpha_0$ in the part other than the angular range B, a flow passage height $h_B'$ of the throat portion 10 in the angular range B is lower than a flow passage height $h_0$ of the throat portion 10 in the part other than the angular range B, decreasing the flow passage area. Thus, the inclination angle α (see FIG. 2) is distributed in the circumferential direction to make the inclination angle $\alpha_B$ in the angular range B smaller than the inclination angle $\alpha_0$ in the part other than the angular range B, then it is possible to make the flow passage height $h_B$ of the throat portion 10 in the angular range B equal to or larger than the flow passage height $h_0$ of the throat portion 10 in the part other than the angular range B. Thus, it is possible to suppress the decrease in the flow passage area.

As described above, since the distance R from the rotational axis L of the impeller 3 to the throat portion 10 in the region in the vicinity of the scroll-end part of the scroll flow passage 5 is greater than the distance R' from the rotational axis L to the throat portion 10 in the region other than the region in the vicinity of the scroll-end part of the scroll flow passage 5, the flow passage area of the diffuser flow passage 7 in the region in the vicinity of the scroll-end part expands, reducing the pressure loss. Thus, it is possible to suppress efficiency degradation of the centrifugal compressor 1 on the high flow rate side.

In embodiment 1, the distance R in the entire angular range B is greater than any distance R' in the part other than the angular range B, and the maximum value $R_{max}$ of the distance R is arranged at the circumferential position where the center angle θ=270°. However the present disclosure is not limited to the embodiment. The average of the distance R need only be greater than the average of the distance R' even if within the angular range B, the distance R which is less than the distance R' of any part other than the angular range B exists, or the distance R' which is greater than the maximum value $R_{max}$ exists in the part other than the angular range B.

In embodiment 1, the flow passage height $h_B$ in the entire angular range B is equal to or higher than any flow passage height $h_0$ in the part other than the angular range B. However, the present disclosure is not limited to the embodiment. The average of the flow passage height $h_B$ need only be greater than the average of the flow passage height $h_0$ even if the flow passage height which is lower than the flow passage height $h_0$ of any part other than the angular range B exists within the angular range B.

In embodiment 1, the first inner wall surface 11*a* and the second inner wall surface 11*b* may replace each other. That is, one of the inner wall surfaces facing each other need only be inclined with respect to the plane P. In addition, the first inner wall surface 11*a* may not be perpendicular to the plane P, but both the first inner wall surface 11*a* and the second inner wall surface 11*b* may be inclined to form the same inclination angle or different inclination angles with respect to the plane P.

Embodiment 2

Next, the centrifugal compressor according to embodiment 2 will be described. The centrifugal compressor according to embodiment 2 has an additional configuration for suppressing efficiency degradation of the centrifugal compressor on the low flow rate side to embodiment 1. In embodiment 2, the same constituent elements as those in embodiment 1 are associated with the same reference numerals and not described again in detail.

Figure 4:
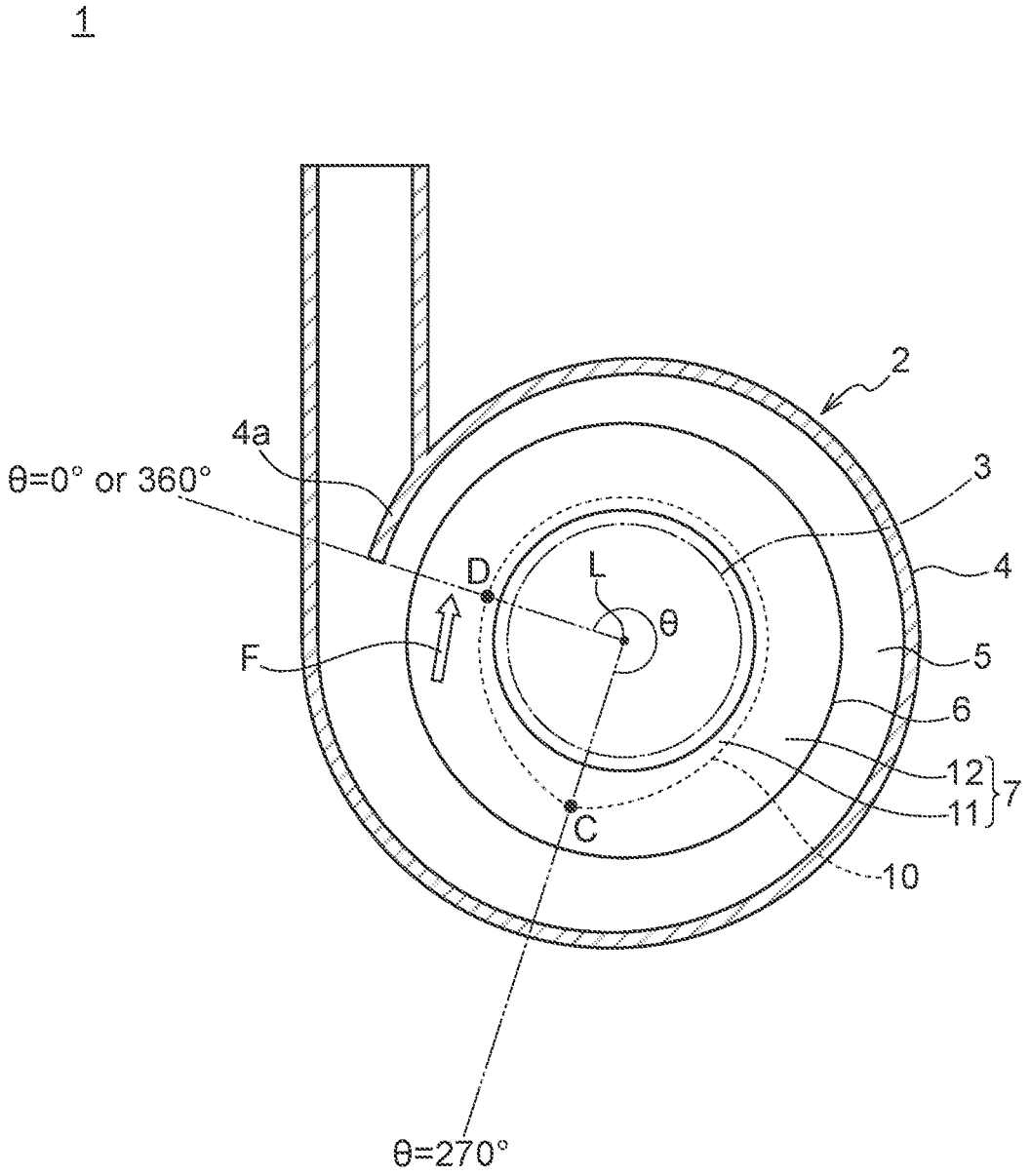
FIG. 4 is a cross-sectional view of the centrifugal compressor according to embodiment 2 of the present disclosure.

As a result of obtaining, by the CFD analysis, a radial velocity distribution in the diffuser flow passage 7 when the centrifugal compressor 1 operates on the low flow rate side, the present inventors find that a stall region expands in a direction from the vicinity of the scroll-end part toward the vicinity of the scroll-start part of the scroll flow passage 5 (the direction of an arrow F) as shown in FIG. 4. On the low flow rate side, since the flow velocity of compressed air downwardly decreases inside the scroll flow passage 5, the compressed air flows back into the diffuser flow passage 7 from the vicinity of the scroll-end part of the scroll flow passage 5, from which stall starts. The backflow from the scroll flow passage 5 has a velocity component in a swirl direction centered on the rotational axis L, expanding the stall region in the direction from the vicinity of the stall-end part toward the vicinity of the stall-start part. Thus, it is possible to improve efficiency of the centrifugal compressor 1 on the low flow rate side by inhibiting the backflow.

Figure 5:
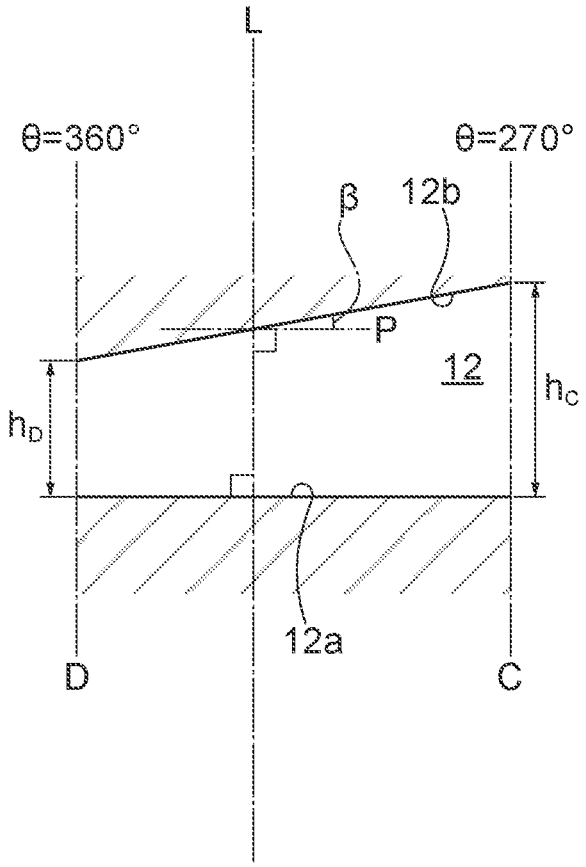
FIG. 5 is a schematic cross-sectional view partially showing an outer flow passage portion of a diffuser flow passage of the centrifugal compressor according to embodiment 2 of the present disclosure.

FIG. 5 is a schematic cross-sectional view of the outer flow passage portion 12 from a circumferential position where the center angle θ=270° (a position C in FIG. 4) to a circumferential position where the center angle θ=360° (a position D in FIG. 4). The flow passage height of the outer flow passage portion 12 in the throat portion 10 (see FIG. 4) decreases circumferentially downward in the range from the position C to the position D. $h_C > h_D$ holds, where he is a flow passage height of the throat portion 10 at the position C, and $h_D$ is a flow passage height of the throat portion 10 at the position D.

In a cross section from the position C to the position D in the circumferential direction, while the third inner wall surface 12*a* is perpendicular to the plane P perpendicular to the rotational axis L, the fourth inner wall surface 12*b* is inclined to form an acute inclination angle β with respect to the plane P so as to approach the third inner wall surface 12*a* from the position C toward the position D, that is, circumferentially downward. Thus, the outer flow passage portion 12 is configured such that the flow passage height of the throat portion 10 decreases circumferentially downward. Other configurations are the same as embodiment 1.

In the above explanation, the flow passage height of the throat portion 10 decreases from the position C to the position D. However, since the third inner wall surface 12*a* and the fourth inner wall surface 12*b* face each other, in a circumferential region where the flow passage height of the throat portion 10 decreases, the flow passage height of the outer flow passage portion 12 at any position in the radial direction decreases. Therefore, the following explanation describes that "the flow passage height of the outer flow passage portion 12 decreases".

In the centrifugal compressor 1, the fourth inner wall surface 12*b* is inclined with respect to the plane P so as to approach the third inner wall surface 12*a* in the direction where the stall region expands (arrow F), decreasing the flow passage height of the outer flow passage portion 12. Thus, the expansion of the stall region in the direction is reduced. As a result, it is possible to suppress efficiency degradation of the centrifugal compressor 1 on the low flow rate side.

In embodiment 2 it is preferable that $0.6 \leq h_D/h_C \leq 0.9$ holds. Thus, it is possible to reduce the expansion of the stall region and to suppress efficiency degradation of the centrifugal compressor 1 on the low flow rate side while minimizing the decrease in the flow passage area of the outer flow passage portion 12.

In embodiment 2, the flow passage height of the outer flow passage portion 12 continuously decreases in the circumferential direction in the entire range from the position C to the position D. However, the present disclosure is not limited to the embodiment. The present disclosure may include a circumferential range where the flow passage height decreases circumferentially downward in the range from the position C to the position D. That is, the flow passage height may decrease only in a partial region in the circumferential direction (circumferential range) in the range from the position C to the position D, and the flow passage height may be constant in another region. Moreover, there may be a plurality of circumferential ranges each in which the flow passage height decreases in the range from the position C to the position D, and the flow passage height may be constant among the plurality of circumferential ranges each in which the flow passage height decreases.

In embodiment 2, the entire flow passage height from the throat portion 10 to the outlet portion 7*b* in the radial direction decreases circumferentially downward. However, the present disclosure is not limited to the embodiment. Although the flow passage height in at least a partial region from the throat portion 10 to the outlet portion 7*b* in the radial direction decreases circumferentially downward, the flow passage height in another region may be constant.

In embodiment 2, the third inner wall surface 12*a* and the fourth inner wall surface 12*b* may replace each other. That is, it is only necessary that one of the inner wall surfaces facing each other is inclined with respect to the plane P. In addition, the third inner wall surface 12*a* may not be perpendicular to the plane P, but both the third inner wall surface 12*a* and the fourth inner wall surface 12*b* may be inclined to form the same inclination angle or different inclination angles with respect to the plane P.

Embodiment 2 adopts an additional configuration to embodiment 1. In the additional configuration, the flow passage height of the outer flow passage portion 12 decreases circumferentially downward within the range where the angular range is between 270° and 360°. However, the present disclosure is not limited to the embodiment. The present disclosure may adopt the configuration of embodiment 2 without the configuration of embodiment 1, for example, while adopting a configuration in which the radial position of the throat portion 10 is constant in the circumferential direction. In this case, it is possible to obtain an effect of suppressing efficiency degradation of the centrifugal compressor 1 on the low flow rate side even though it is impossible to obtain an effect of suppressing efficiency degradation of the centrifugal compressor 1 on the high flow rate side.

REFERENCE SIGNS LIST

1 Centrifugal compressor
2 Housing
3 Impeller
4 Scroll portion
4*a* Tongue section
5 Scroll flow passage
6 Diffuser portion
7 Diffuser flow passage
7*a* Inlet portion (of diffuser flow passage)
7*b* Outlet portion (of diffuser flow passage)
10 Throat portion
11 Inner flow passage portion
11*a* First inner wall surface
11*b* Second inner wall surface
12 Outer flow passage portion
12*a* Third inner wall surface
12*b* Fourth inner wall surface
$h_0$ Flow passage height (of throat portion)
$h_B$ Flow passage height (of throat portion)
$h_C$ Flow passage height (of throat portion)
$h_D$ Flow passage height (of throat portion)
A Region
B Angular range
C Position
D Position
L Rotational axis (of impeller)
P Plane
R Distance
$R_{max}$ Maximum value (of distance R)
α Inclination angle
β Inclination angle
θ Center angle

The invention claimed is:

1. A centrifugal compressor comprising an impeller and a housing, wherein the housing includes:

a scroll portion with a spiral scroll flow passage being formed on an outer peripheral side of the impeller; and a diffuser portion with a diffuser flow passage being formed, the diffuser flow passage extending along the scroll flow passage on a radially inner side of the scroll flow passage and communicating with the scroll flow passage, wherein the diffuser flow passage includes:

an inner flow passage portion extending from an inlet portion of the diffuser flow passage to a throat portion with a flow passage height thereof decreasing, the throat portion being positioned on a radially outer side of the inlet portion; and an outer flow passage portion extending from the throat portion to an outlet portion of the diffuser flow passage, and wherein an average distance from the rotational axis to the throat portion within a range where an angular range in a circumferential direction with reference to a tongue section of the scroll portion is between 240° and 300° is greater than an average distance from the rotational axis to the throat portion outside the range where the angular range is between 240° and 300°.

2. The centrifugal compressor according to claim 1, wherein a distance from the rotational axis to the throat portion changes at least partially in the circumferential direction, and becomes maximum within the range where the angular range is between 240° and 300°.

3. The centrifugal compressor according to claim 1, wherein an average flow passage height in the throat portion within the range where the angular range is between 240° and 300° is not less than an average flow passage height in the throat portion outside the range where the angular range is between 240° and 300°.

4. The centrifugal compressor according to claim 3, wherein the diffuser portion has a first inner wall surface and a second inner wall surface defining the inner flow passage portion therebetween, the first inner wall surface being perpendicular to the rotational axis, the second inner wall surface being inclined to faun an acute inclination angle with respect to a plane perpendicular to the rotational axis so as to approach the first inner wall surface from the inlet portion to the throat portion, and wherein an average of the inclination angle within the range where the angular range is between 240° and 300° is less than an average of the inclination angle outside the range where the angular range is between 240° and 300°.

5. The centrifugal compressor according to claim 1, wherein the outer flow passage portion has a circumferential range where a flow passage height thereof in at least a partial region from the throat portion to the outlet portion in a radial direction decreases circumferentially downward within a range where the angular range is between 270° and 360°.

6. The centrifugal compressor according to claim 5, wherein the diffuser portion has a third inner wall surface and a fourth inner wall surface defining the outer flow passage portion therebetween, the third inner wall surface being perpendicular to the rotational axis, and wherein the fourth inner wall surface has the circumferential range where the fourth inner wall surface is inclined with respect to a plane perpendicular to the rotational axis so as to approach the third inner wall surface circumferentially downward within the range where the angular range is between 270° and 360°.

7. The centrifugal compressor according to claim 5, wherein $0.6 \leq h_D/hc \leq 0.9$ holds, where, in the circumferential range, hc is a flow passage height in at least the partial region on a most upstream side in the circumferential direction, and $h_D$ is a flow passage height in at least the partial region on a most downstream side in the circumferential direction.

8. A turbocharger comprising the centrifugal compressor according to claim 1.

* * * * *